US008773137B2

(12) United States Patent
Bertelli

(10) Patent No.: US 8,773,137 B2
(45) Date of Patent: Jul. 8, 2014

(54) METHOD AND DEVICE TO DETECT THE FLAME IN A BURNER OPERATING ON A SOLID, LIQUID OR GASEOUS COMBUSTIBLE

(75) Inventor: Pierluigi Bertelli, Bardolino (IT)

(73) Assignee: Bertelli & Partners, S.R.L., Angiari (IT)

( * ) Notice: Subject to any disclaimer, the term of this patent is extended or adjusted under 35 U.S.C. 154(b) by 566 days.

(21) Appl. No.: 12/921,166

(22) PCT Filed: Mar. 7, 2008

(86) PCT No.: PCT/IT2008/000151
§ 371 (c)(1),
(2), (4) Date: Sep. 30, 2010

(87) PCT Pub. No.: WO2009/110015
PCT Pub. Date: Sep. 11, 2009

(65) Prior Publication Data
US 2011/0018544 A1 Jan. 27, 2011

(51) Int. Cl.
*G01N 27/62* (2006.01)
*F23N 5/12* (2006.01)

(52) U.S. Cl.
CPC ..... *F23N 5/123* (2013.01); *F23N 5/126* (2013.01); *F23N 2029/08* (2013.01); *F23N 2029/12* (2013.01)
USPC ..... 324/459; 340/577; 340/578; 340/579; 431/42

(58) Field of Classification Search
CPC ..... F23N 2029/00; F23N 2029/02; F23N 2029/04; F23N 2029/06; F23N 2029/08; F23N 5/126; F23N 5/123
USPC ..... 324/459; 340/577–579; 431/42
See application file for complete search history.

(56) References Cited

U.S. PATENT DOCUMENTS 3,238,423 A 3/1966 Giuffrida et al.
3,266,026 A 8/1966 Plambeck
(Continued)

FOREIGN PATENT DOCUMENTS

JP S58108328 A 6/1983
JP 61243217 A * 10/1986
(Continued)

OTHER PUBLICATIONS

International Search Report dated Dec. 2, 2008 for PCT/IT2008/000151 to Bertelli et al., filed Jul. 3, 2008.

*Primary Examiner* — Huy Q Phan
*Assistant Examiner* — Adam Clarke
(74) *Attorney, Agent, or Firm* — Novak Druce Connolly Bove + Quigg LLP

(57) ABSTRACT

A method for flame sensing in a solid, liquid or gaseous fuel burner, the flame generated at an ionization electrode, the flame presence resulting in an ionizing effect on the electrode. The electrode is powered by an alternating voltage signal. The ionization phenomenon generates in the electrode a direct current. The current being sensed by a suitable sensing circuit including a control unit. This signal generator being of relatively low internal impedance to enable the measured generated current to have a high value compared with that normally used and of waveform to tend to limit the value of the direct current flowing through the electrode. The sensing and control circuit being such as to enable the presence of a parasitic current on the flame sensing electrode to be measured. A device for implementing the method is also disclosed.

12 Claims, 3 Drawing Sheets

(56) References Cited

U.S. PATENT DOCUMENTS

Figure 1:
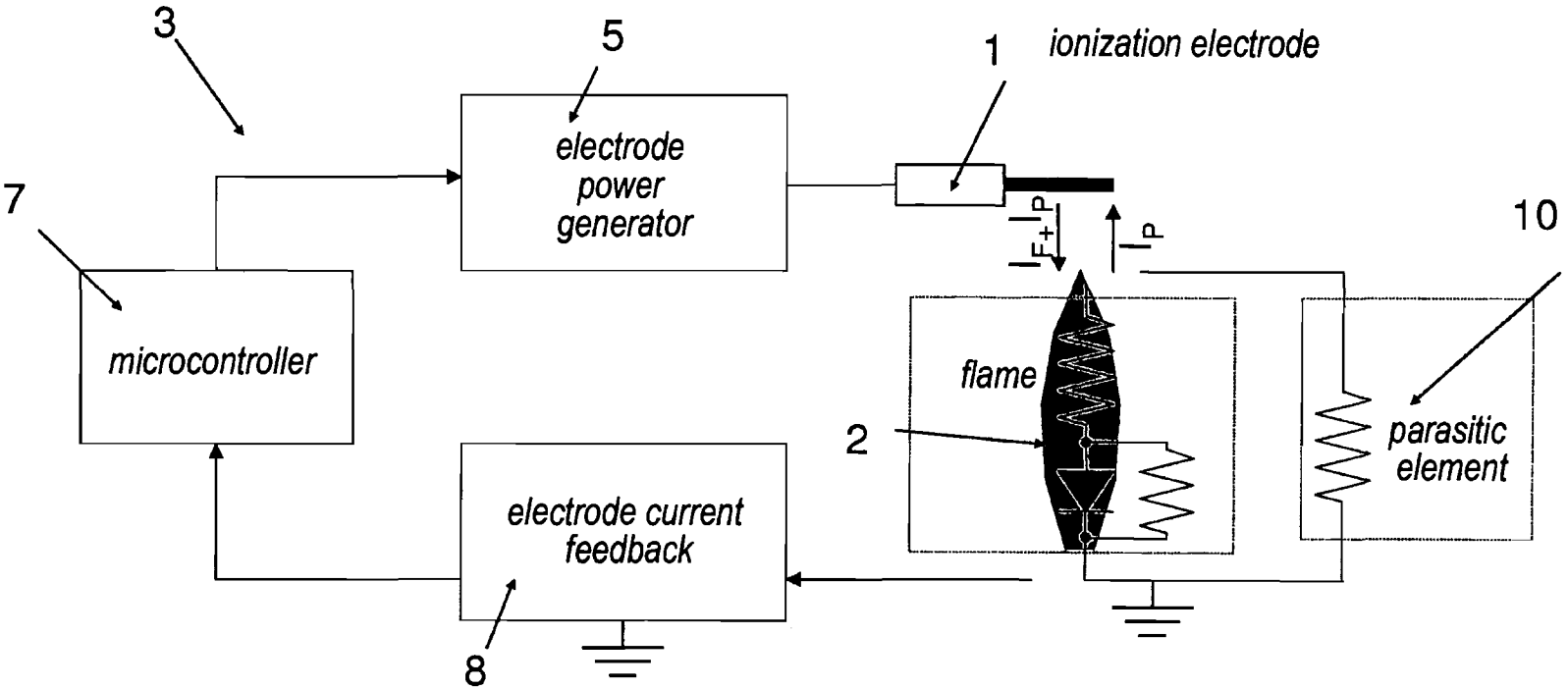
Figure 2:
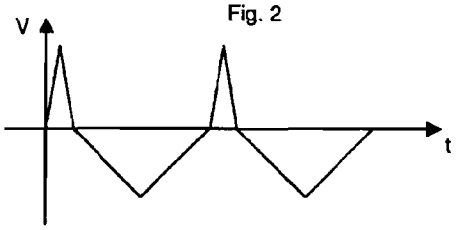
Figure 3:
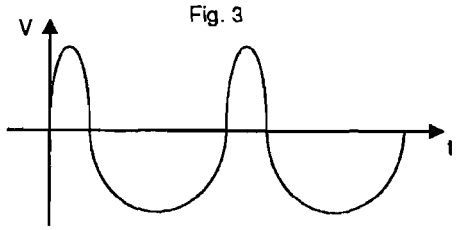
Figure 4:
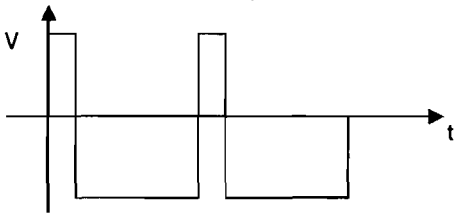
Figure 5:
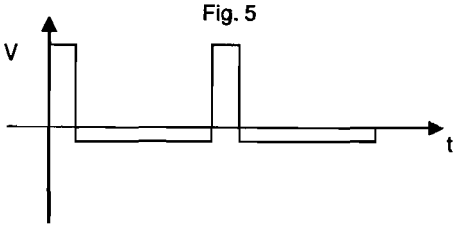
Figure 6:
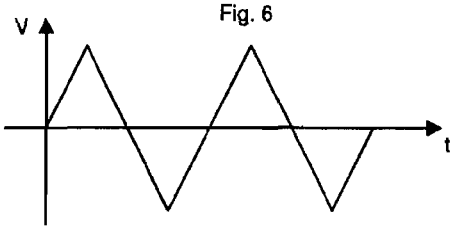
Figure 7:
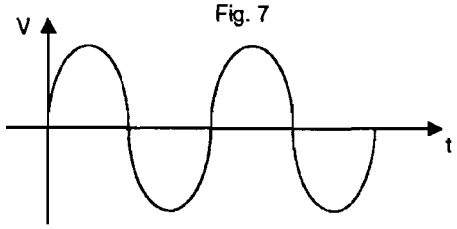
Figure 8:
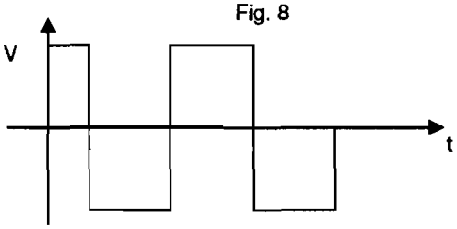
Figure 9:
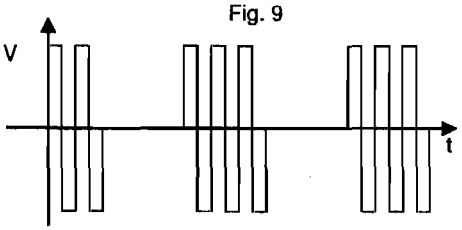

| | | | | |
|---|---|---|---|---|
| 4,088,984 | A | 5/1978 | Muramoto et al. | |
| 4,423,411 | A * | 12/1983 | van der Walt et al. | 340/629 |
| 5,073,104 | A * | 12/1991 | Kemlo | 431/12 |
| 5,472,337 | A * | 12/1995 | Guerra | 431/78 |
| 5,577,905 | A | 11/1996 | Momber et al. | |
| 6,084,518 | A * | 7/2000 | Jamieson | 340/577 |
| 6,356,199 | B1 * | 3/2002 | Niziolek et al. | 340/579 |
| 6,501,383 | B1 * | 12/2002 | Haupenthal | 340/578 |
| 6,985,080 | B2 * | 1/2006 | Kociecki et al. | 340/577 |
| 2002/0004186 | A1 | 1/2002 | Lochschmied | |
| 2004/0185397 | A1 * | 9/2004 | Branston et al. | 431/2 |
| 2005/0250061 | A1 * | 11/2005 | Lochschmied | 431/75 |
| 2006/0257804 | A1 * | 11/2006 | Chian et al. | 431/24 |
| 2006/0275719 | A1 * | 12/2006 | Hill et al. | 431/24 |
| 2007/0172959 | A1 * | 7/2007 | Fullemann et al. | 436/149 |
| 2008/0145802 | A1 * | 6/2008 | Hammer et al. | 431/2 |
| 2010/0301870 | A1 * | 12/2010 | Muller et al. | 324/464 |
| 2011/0070550 | A1 * | 3/2011 | Arensmeier | 431/12 |
| 2013/0330675 | A1 * | 12/2013 | Strong | 431/6 |

FOREIGN PATENT DOCUMENTS

| | | | |
|---|---|---|---|
| JP | S62005014 | A | 1/1987 |
| JP | 63201420 | A | 8/1988 |
| JP | S63318421 | A | 12/1988 |
| WO | 2007/132484 | A | 11/2007 |

* cited by examiner

METHOD AND DEVICE TO DETECT THE FLAME IN A BURNER OPERATING ON A SOLID, LIQUID OR GASEOUS COMBUSTIBLE

CROSS-REFERENCE TO RELATED APPLICATION

This application is a 0371 National Stage Application of International Application No. PCT/IT2008/000151, filed on 7 Mar. 2008.

The present invention relates to a method for sensing or detecting the presence of the flame in a solid, liquid or gaseous fuel burner, in accordance with the introduction to the main claim. The invention also relates to a sensing device therefore in accordance with the introduction to the corresponding independent claim.

In a burner of solid, liquid or gaseous fuel or combustible type it is known to be important to sense the flame in order to monitor and verify burner operation. It is also important to verify correct combustion within the burner to ascertain if the boiler operates within predetermined parameters from the viewpoint of controlling the emission of pollutant combustion products into the atmosphere.

To achieve said flame sensing (and monitoring), a known method uses the known is flame rectification effect as produced by the combustion of a solid, liquid or gaseous fuel in a burner. By virtue of this effect, flame formation can be sensed by integrating and measuring a direct current flowing through an electrode positioned in the burner (reduced surface) and fed with alternating voltage towards the burner plane (extended surface).

This phenomenon is commonly used to sense the presence of the flame and, being (see for example the 1970 publication "Brulers Industriels à Gaz" by Pierre Hostallier) related to the flame combustion quality, also as a combustion process feedback sensor.

In known methodologies and corresponding systems or devices, a burner equivalent circuit is "constructed" in which the flame equivalent model is conventionally simplified by means of a first electrical branch comprising a diode in series with a resister of low ohmic value (typically between 100 KOhm and 10 MOhm) connected in parallel with a second branch presenting a high resistance (typically 50-100 MOhm). During the device positive feed phase (alternating voltage in the positive phase), current circulates through the first branch; during the negative phase of the alternating wave, current circulates through the second branch. This latter current is normally of negligible value so has not normally been considered as it has no influence on the flame signal evaluation so far carried out. In these known devices, the electrode is positioned at the flame and is powered by voltage; by utilizing the aforesaid ionisation phenomenon, a direct current passage is sensed (normally by a signal integration circuit) in the electrode corresponding to the presence of the flame. This current is essentially attributed to that circulating in the first electrical branch representing the flame model. This current contains both a value corresponding to that generated by the flame (and hence related to the combustion) and a value corresponding to a possible parasite current generated by factors external to the flame (for example moisture, impurities on the control device circuit card, etc.). Consequently, with known is devices the "flame signal" sensed can be a spurious signal, not only related to fuel combustion.

The alternating voltage usually used can have various forms, for example sinusoidal, triangular, square wave, intermittent (see for example FIGS. 6-9), but characterised by always having a virtually zero mean value (considered as the sum of the positive part and negative part).

Particularly when viewed for use as feedback in the combustion process, conventional sensing methods have certain limitations; these include the following:

A. Usually high impedance of the electrode powering circuit such that the flame current levels (i.e. those linked to combustion) under the limited conditions of correct combustion are very difficult to distinguish, as the correlation curve between the flame and the combustion parameters (flame lambda signal) becomes flat, in particular at high flame power and signal. Commercial systems typically operate at flame currents between 5 and 30 microamperes.

B. Signal dependence on oxide formation on the electrode rod. These oxides form an insulating layer between the electrode and the flame and over time cause a reduction in the flame signal and sometimes instability. These phenomena can affect the reliability of the reading of the correlation between the flame and the combustion quality signal and, notwithstanding periodical re-verification and automatic resetting algorithms, lead to temporary or long-term boiler operation under incorrect combustion conditions.

C. The possible presence of parasitic impedances (for example due to high humidity or condensate formation) between the electrode and the reference (the burner plane) which falsify correct reading of the flame signal with the consequences under the preceding point B).

D. In low-cost systems the reading is made using high impedance circuit elements. Again, the presence of parasitic impedances at the circuit level (impurities or moisture or condensate on the electronic card carrying said is impedances) leads to that already described under points B) and C).

Many commercially available devices present the above drawbacks and limitations: in particular, from checks on some of said devices of gas boiler type, it has been shown that the above limitations lead to various practical inconveniences, including:

- permanent or long-term boiler operation under combustion parameters which differ even significantly from the optimal or desired value, and frequently outside the "low pollution" combustion parameters defined by regulations;
- "hiccup" operation resulting from possible temporary parasitic impedance formation (for example moisture which forms and then dissolves by heat);
- total exit of parameters from allowable range for boiler operation; this can lead to the need for a new automatic setting procedure for the system (this term meaning the combination of control device, burner, electrode and related elements) to attempt to approach correct combustion (but which may not achieve the desired result, because of the above) or can lead in the worst case to complete stoppage of operation of this system and of the boiler, with consequences for user comfort. An object of the present invention is to provide a method and an implementing device for flame sensing in a solid, liquid or gaseous fuel burner which represent an improvement compared with the known methods and known implementing devices.

A particular object of the invention is to provide a method enabling correct boiler operation with the aim of achieving a greater combustion parameter constancy with time.

Another object is to provide a method enabling boiler combustion to be controlled for a wide burner operating power range.

A further object is to provide a method and corresponding device allowing limitation of the appearance of parasitic phenomena within the boiler to affect optimal combustion.

Another object is to provide a method by which the functionality of the system obtained is virtually independent of the formation of oxide layers on the flame sensing electrode.

These and other objects which will be apparent to the expert of the art are attained by a method and device in accordance with the accompanying claims.

Figure 10:
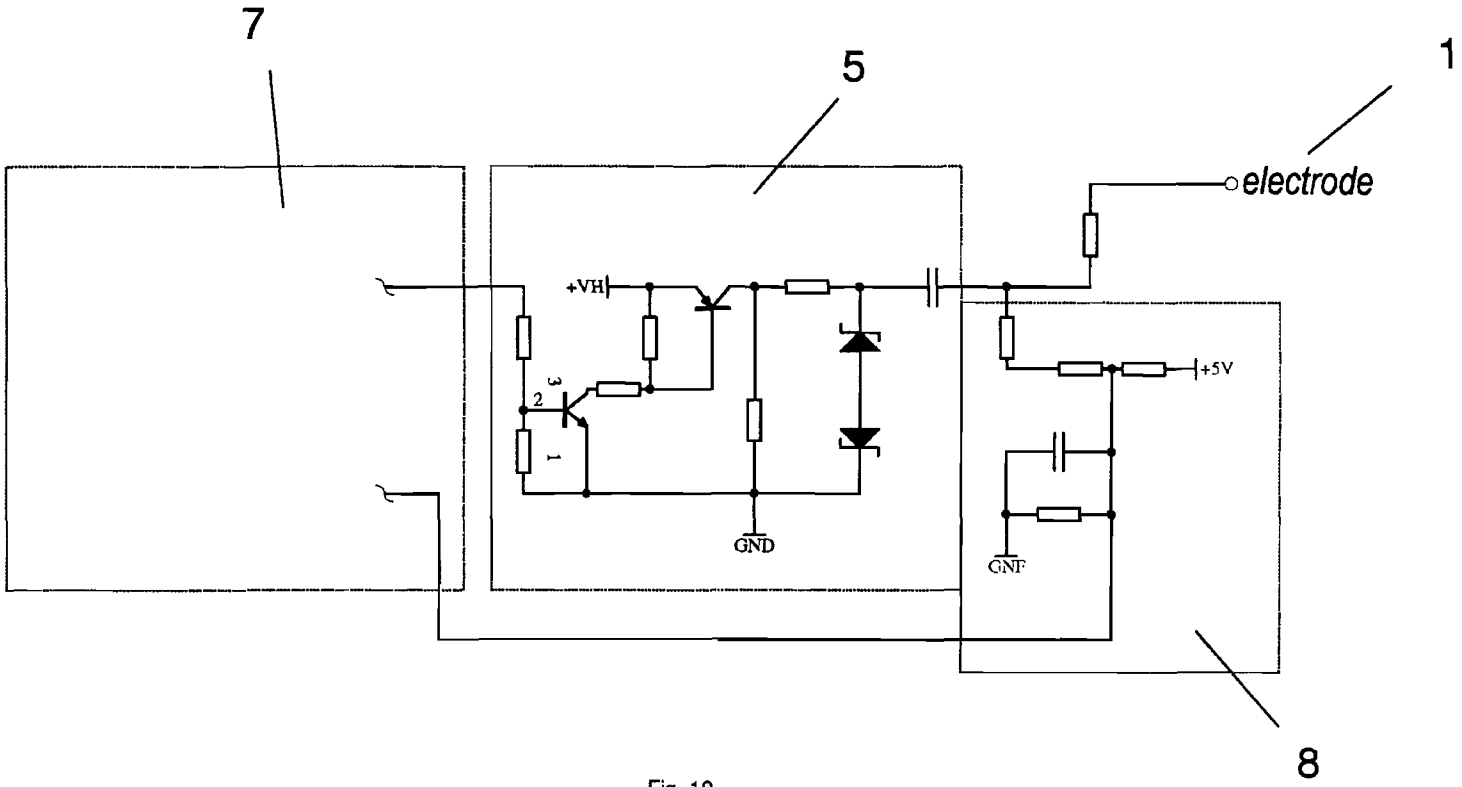

The present invention will be more apparent from the accompanying drawings, which are provided by way of non-limiting example and in which:

FIG. 1 shows a block scheme of a possible device embodying the invention;

Figures from 2 to 5 show graphs relative to various voltage waveforms against time, usable by the method of the invention;

Figures from 6 to 9 show graphs relative to various waveforms used normally on commercially available devices;

FIG. 10 shows a simplified circuit diagram of the device of FIG. 1.

With reference to said figures, an ionization electrode 1 is disposed in known manner at a flame 2 of a burner fed with a fuel which can be gaseous, liquid or solid. The electrode 1 is connected to a flame sensing and control circuit 3 operating in accordance with the method of the present invention.

According to the invention, the electrode 1 is powered with alternating voltage by a generator or source 5 of relatively low internal impedance. The source 5 or alternating voltage generator for the electrode 1 is controlled by a control unit 7 which receives a feedback signal from a known flame current sensing circuit 8 (for example comprising a shunt) which senses the current corresponding to the state of the flame 2. The internal impedance of the generator is such as to enable a flame current value to be measured which is typically between 15 and 200 microamperes depending on the burner operating regime and the fuel type.

The electrode 1 is powered with alternating voltage (this meaning a signal partly with electrode positive polarity towards earth and partly with electrode negative polarity towards earth) of amplitude variable between 2V and 1000V, is advantageously between 10V and 200V. The voltage signal has a frequency between 1 Hz and 10 KHz, advantageously between 10 Hz and 2 KHz, and a duty cycle variable between 0.1% and 99.9%, advantageously between 1% and 30%. This voltage signal has a positive value within a time range much smaller than the range in which the voltage value is negative. In other words, the positive part of the signal is of much shorter duration than the negative part of the signal, within each period.

More specifically, according to the method of the invention, the current which circulates through the electrode 1, powered by an alternating voltage of the aforesaid form, by virtue of the ionising effect of the flame 2 with which the electrode 1 is in contact, is measured. On the basis flame current values predefined for the particular burner type and fuel type (set at the design stage on the basis of tests carried out on various types of burners and fuels), the duty cycle and the amplitude of the positive part and negative part of the waveform of the voltage powering the electrode are defined such as to reduce to a value less than 1, preferably much less than 1, the ratio of the direct current flowing through the electrode to the flame current measured.

By using the invention, the system obtained is strongly independent of the negative influence of the flame signal due to the formation of oxide layers on the surface of the sensing electrode.

This reduces to a minimum the influence on the system of one of the main causes which can affect the reliability of the reading of the flame-combustion quality correlation signal (this also enabling a continuous and correct control to be obtained of the combustion taking place within the burner in order to prevent exhaust gas emission in percentages outside the norm); by using the voltage source 5 of relatively low impedance and with a voltage signal as described above, the invention also enables the influence of parasitic impedances on the combustion control unit 7 to be reduced to also allow correct measurement of the is signal generated by the electrode in the presence of a flame and relative only to this latter.

This reduction in the influence of parasitic impedances is linked both to the use of circuit components with low impedances and to the use of a particular method of measuring current due to the external parasitic elements described hereinafter.

This also facilitates the use of the present methodology for combustion verification, including in systems with a wide range of operating power.

Even though little sensitive to parasitic elements, the device of the invention is used both for measuring the current relative to the flame signal (even containing possible influences by external parasitic components, signal defined as positive by convention), and for reading the negative component of the current flowing through the electrode, i.e. the current due to only the parasitic elements (for example moisture).

In this respect, representing the parasitic element by a resistor 10, the current circulating through it when the alternating voltage signal is in the negative part is measured. This measurement is obtained in a manner known to the expert of the art, and will therefore not be further discussed.

This current (parasitic or negative) is measured by the unit 7 which hence receives the negative feedback signal generated by this resistor (and containing only the value of the parasitic current) and the positive signal containing the value of the sum of the flame current $I_F$ and parasitic current $I_P$; using a calculation algorithm, the unit 7 takes the difference between the measured values and identifies the value of the current due to the flame alone ($I_F$).

In this manner, with the invention it is possible to measure parasitic impedances at the electrode, so far not done in the state of the art. It should be noted that in the flame model shown schematically in FIG. 1, the reverse current due to the flame alone (circulating through the resistor in parallel with the diode) is shown to be a fraction of the order of 1/100-1/200 of the direct current and hence negligible; is the reverse current measured when the powering voltage signal is in its negative part is consequently attributed entirely to parasitic phenomena. The measurement made is therefore "cancelled" by the measurement of the (direct) current to give as the result only the value dependent on the flame quality.

The system defined in this manner is therefore self-adapting even in the presence of extremely low external parasitic impedances (of the order of hundreds of KOhms equal to ½-⅓ of the direct flame signal), to which it is insensitive.

The system is also virtually insensitive to oxide formation on the rod of the flame sensing electrode.

All these characteristics, confirmed by experiment, mean that the device of the present invention provides improved combustion verification compared with currently available devices and is able to act on the combustion regulating actuator and on the actuator regulating air feed to the burner such as to achieve predetermined parameters. The invention ensures that the operating parameters required for the burner are maintained more reliably with time, so reducing to a minimum the need for (or indeed not requiring) periodic automatic resetting procedures.

The invention claimed is:

1. A method for flame sensing in a solid, liquid or gaseous fuel burner, comprising the steps of:

generating said flame at an ionization electrode, presence of the flame resulting in an ionising effect on said ionization electrode to generate in this ionization electrode a direct current, said direct current being sensed by a sensing circuit comprising a control unit, said control unit connected to a flame current sensing circuit for sensing a flame current, the flame current corresponding to the state of the flame, generating, directed towards the ionization electrode, an alternating voltage signal of waveform, amplitude and duty cycle to reduce to a value less than 1 the ratio of the direct current flowing through the electrode to measured flame current, wherein said alternating voltage signal is generated by a generator of relatively low impedance, between 50 KOhm and 5 MOhm, the control unit measuring the value of the negative current due to parasitic elements, this control unit subtracting that value of the negative current due to parasitic elements from the current value or positive current measured in the positive part of the feed voltage, originating from the electrode and generated both by electrode ionization due to flame and by the parasitic element, this enabling a value to be identified for the current effectively generated by just the flame on the electrode.

2. A method as claimed in claim 1, wherein the voltage signal is generated on the basis of the type of burner and of the fuel burnt therein.

3. A method as claimed in claim 1, wherein said alternating voltage signal has an amplitude variable between 2V and 1000V, advantageously between 10 and 200V.

4. A method as claimed in claim 1, wherein said voltage signal has a frequency between 1 Hz and 10 KHz, advantageously between 10 Hz and 2 KHz.

5. A method as claimed in claim 1, wherein said voltage signal has a duty cycle positive portion variable between 0.1% and 99%, advantageously between 1% and 30%.

6. A method as claimed in claim 1, comprising measuring a negative current flowing through the electrode when the feed voltage is in the negative part and caused by parasitic elements within the burner.

7. A method as claimed in claim 1, measuring a negative current flowing through the electrode when the feed voltage is in the negative part and caused by parasitic elements within the burner, said parasitic elements comprising moisture.

8. A method as claimed in claim 1, wherein said voltage signal has a duty cycle positive portion variable between 1% and 30%.

9. A device for flame sensing in a solid, liquid or gaseous fuel burner, said device comprising:

an ionization electrode positioned at a flame, this flame for ionizing the electrode and generating a direct current therein, a sensing circuit for sensing said current the sensing circuit comprising a control unit for controlling correct fuel combustion within the burner, said control unit being connected to a flame current sensing circuit for sensing a flame current corresponding to the state of the flame, a voltage generator arranged to generate, directed towards the electrode, an alternating voltage signal of waveform, amplitude and duty cycle to reduce to a value less than 1 the ratio of the direct current flowing through the electrode to measured flame current, this enabling a correlation to be obtained between the flame current and predetermined combustion parameters which is more reliable with time, wherein said voltage generator is of relatively low impedance, between 50 KOhm and 5 MOhm and that enables a flame current value to be measured;

the control unit for measuring the value of the negative current due to parasitic elements, this control unit subtracting that value of the negative current due to parasitic elements from the current value or positive current measured in the positive part of the feed voltage, originating from the electrode and generated both by electrode ionization due to flame and by the parasitic element, this enabling a value to be identified for the current effectively generated by just the flame on the electrode.

10. A device as claimed in claim 9, comprising an electrical feedback circuit to sense a positive current due both to the flame presence and to parasitic elements generated within the electrode.

11. A device as claimed in claim 9, wherein the electrical feedback circuit enables negative currents generated within the electrode and due just to parasitic elements to be sensed.

12. A device as claimed in claim 9, wherein said voltage generator of relatively low impedance, between 50 KOhm and 5 MOhm enables a flame current value between 15 and 200 microamperes to be measured.

* * * * *